US006367466B1

(12) United States Patent
Nettles, Jr.

(10) Patent No.: US 6,367,466 B1
(45) Date of Patent: Apr. 9, 2002

(54) PAINTBALL GUN CRADLE

(76) Inventor: Ronald E. Nettles, Jr., 24 Joyce Ave., Mt. Pleasant, SC (US) 29464

( * ) Notice: Subject to any disclaimer, the term of this patent is extended or adjusted under 35 U.S.C. 154(b) by 0 days.

(21) Appl. No.: 09/640,217

(22) Filed: Aug. 16, 2000

(51) Int. Cl.[7] ..... F41A 27/00
(52) U.S. Cl. ..... 124/80; 42/94
(58) Field of Search ..... 42/74, 91.01, 124, 42/125, 128, 94; 248/139, 108

(56) References Cited

U.S. PATENT DOCUMENTS 1,072,203 A * 9/1913 Boecker ..... 42/94
3,827,172 A * 8/1974 Howe ..... 42/94
3,964,613 A * 6/1976 Anderson, Jr. ..... 211/64
4,007,554 A 2/1977 Helmstadter
4,026,057 A * 5/1977 Cady ..... 42/94
4,438,581 A * 3/1984 LaValle ..... 42/94
4,449,314 A 5/1984 Sorensen
4,461,385 A * 7/1984 Clouser ..... 211/4
4,624,372 A * 11/1986 Brolin ..... 211/4
4,841,839 A * 6/1989 Stuart ..... 89/37.04
4,858,359 A * 8/1989 Danz ..... 42/94
4,873,777 A 10/1989 Southard
4,971,208 A * 11/1990 Reinfried, Jr. et al. ..... 211/64
4,972,619 A * 11/1990 Eckert ..... 42/94
4,998,944 A * 3/1991 Land ..... 42/94
5,058,302 A * 10/1991 Minneman ..... 42/94
5,070,636 A * 12/1991 Mueller ..... 42/94
5,074,188 A * 12/1991 Harris ..... 89/37.04
5,081,783 A * 1/1992 Jarvis ..... 42/94
5,173,563 A * 12/1992 Gray ..... 42/94
5,333,829 A * 8/1994 Bell et al. ..... 248/634
5,370,105 A * 12/1994 Firman ..... 124/94
5,375,905 A * 12/1994 Flitter et al. ..... 297/15
5,628,135 A 5/1997 Cady
5,642,584 A * 7/1997 Riggenbach ..... 42/85
5,666,757 A 9/1997 Helmstadter
5,682,700 A * 11/1997 Sandberg ..... 42/94
5,758,447 A * 6/1998 Venetz ..... 42/94
5,811,720 A * 9/1998 Quinnell et al. ..... 89/37.04
5,845,427 A * 12/1998 Taylor ..... 42/94
5,875,580 A * 3/1999 Hill et al. ..... 42/94
5,937,561 A * 8/1999 Abernethy ..... 42/94
5,964,435 A * 10/1999 Peltier ..... 248/166
5,979,099 A * 11/1999 Kervin ..... 42/94

* cited by examiner

*Primary Examiner*—Charles T. Jordan
*Assistant Examiner*—Stephen Holzen
(74) *Attorney, Agent, or Firm*—Harleston Law Firm; Kathleen M. Harleston

(57) ABSTRACT

A paintball gun support cradle includes: (a) a generally horizontal support base adapted to be disposed on a supporting surface, which includes: (1) a pair of elongated side members, which are parallel to each other and are adapted for supporting a paintball gun gas cylinder between them, and (2) one or two cross members which connect the side members; (b) a vertical arm member having an upper end and an opposite, lower end, the lower end being coupled to the cross member, the vertical arm member extending generally perpendicularly upward relative to the length of the support base; and (c) a T-shaped T-bar portion attached to the upper end of the vertical arm member. The T-bar portion is adapted for supporting a gun barrel.

17 Claims, 6 Drawing Sheets

PAINTBALL GUN CRADLE

BACKGROUND OF THE INVENTION

1. Technical Field

The present device is a support, or cradle, for holding a paintball gun when it is not in play.

2. Background Information

The number of people playing the game of paintball indoors and out has increased a great deal in the last five years or so. It is an especially popular weekend activity for young adults, particularly men in their 20s and 30s. Specialized equipment is necessary to play the sport, including face masks and vests. Most importantly, each player needs a paintball gun in order to play. Paintball guns include a detachable, reloadable paint ball dispenser, which drops a line-up of paint balls into the gun for firing. The gun is connected to a pressurized gas tank, usually oxygen or carbon dioxide, which provides the force required to fire the paint ball from the gun. The paint ball dispenser is normally at the top of the gun, and the gas cylinder is normally positioned below the gun. The paintball gun includes a long barrel through which the paint balls are fired, a handle, and a trigger.

Some cities have paintball stores and indoor arenas which rent paintball guns to players. Serious enthusiasts, though, have purchased their own paintball guns, which can be quite expensive and "hi-tech". Since paintball gun cradles are not generally available, paintball guns and their attachments are frequently tossed on the ground or on tables during breaks in the game. The gas cylinder at the bottom of the paintball gun apparatus makes it difficult to store paintball guns in an orderly fashion. On occasion, a player cannot immediately locate his or her gun, or picks up the wrong gun from among the jumble of guns on the ground. Another disadvantage is that dirt, mud, stones or crawling insects can enter or damage the barrel or other parts of the gun. Also, the rough treatment may damage parts of the gun, all needlessly adding to the cost of this form of recreation.

The present invention is a paintball gun cradle used to conveniently store a paintball gun when it is not in use. The gun cradle of the present invention has many advantages, aside from providing a boost in player status. The cradle is lightweight and easy to use, and may be carried along as easily as a paintball gun. With the present invention, it is no longer necessary to toss expensive paintball guns on the ground or other surfaces. The guns are not as likely to be scratched or damaged when they are stored in this cradle. When the cradle of the present invention is used, it is easier for a player to locate his or her gun, and players are not as likely to pick up someone else's gun. When this gun support is used, it is less likely that dirt, mud, stones or crawling insects will enter and damage the barrel or other parts of the paintball gun.

Since the paintball gun cradle is as portable as the paintball gun itself, it may be used anywhere a paintball gun is used. The paintball gun cradle is especially useful outdoors at the site where the paintball game is played. The paintball gun is likely to receive rough treatment in the field. The paintball gun cradle of the present invention may also be used indoors to protect paintball guns when they are being stored.

BRIEF SUMMARY OF THE INVENTION

The present invention is a cradle for supporting a paintball gun when it is not in use. The cradle includes:

(a) a generally horizontal support base adapted to be disposed on a supporting surface, the support base comprising: (1) a pair of elongated side members, which are parallel to each other and are adapted for supporting a lower side of a paintball gun gas cylinder between them, each side member having a front end and an opposite rear end, and (2) a cross member having two opposite ends, each affixed to the front end of one of the side members; the cross member connecting the side members;

(b) a vertical arm member having an upper end and an opposite, lower end, the lower end being coupled to the cross member, the vertical arm member extending generally perpendicularly upward relative to the length of the support base; and (c) a T-shaped T-bar portion attached to the upper end of the vertical arm member, the T-bar portion being adapted for supporting a gun barrel.

The vertical arm member preferably folds downward toward the support base for easier carrying and storage. It may also telescope to accommodate guns of different heights and shapes and guns with different sized gas cylinders.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
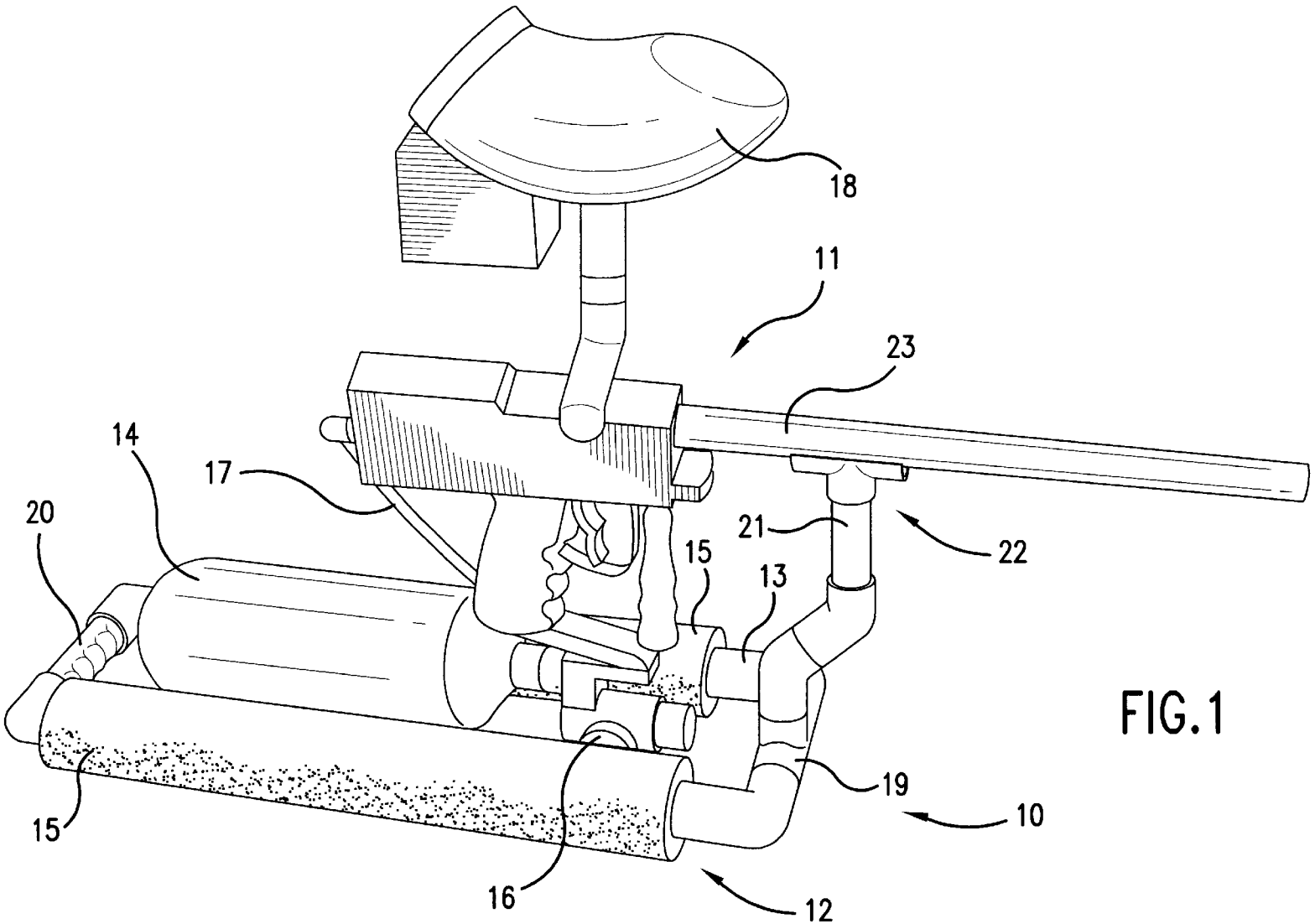
FIG. 1 is a perspective view of a paintball gun cradle according to the present invention, shown with a paintball gun in the cradle.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIG. 1, a portable cradle 10 for supporting a paintball gun apparatus 11 is constructed according to the present invention. The frame of the paintball gun cradle 10 is constructed of a sturdy, rust resistant, lightweight material, preferably polyvinyl chloride (PVC) pipe. The cradle 10 includes a generally horizontal support base 12 adapted to be disposed on a supporting surface, such as the ground, a bench, a floor, or a table. The support base preferably includes a pair of elongated, spaced apart side members 13, which are parallel to each other. Paintball guns, also called markers, normally have a cylinder 14 of pressurized gas mounted at the bottom. The side members 13 are adapted for supporting a lower side of the paintball gas cylinder 14 between them. The gas cylinder rests on its side between the side members, though it preferably does not extend below the bottom of the side members, so that the cylinder does not rest on the ground. There are currently two standard size gas cylinders used with paintball guns. Both of these sizes can be accommodated by the present invention.

As shown in FIG. 1, the support base is preferably padded at the points of contact with the gas cylinder 14 of the paintball gun apparatus 11. The padding 15 preferably surrounds the side members 13 to cushion the gas cylinder 14 of the paintball gun apparatus 11, and protect the surface the cradle is placed upon, such as a table. Such padding may be made of foam, plastic, rubber, or the like. Alternatively, the side members can be coated so that they do not damage the outside of the gas cylinder, and vice versa. The padding 15 or side members 13 can be brightly colored to match the paint job of the owner's gun, and may include advertising or slogans.

This gun cradle is for temporarily holding paintball guns and their attachments for testing, maintenance, repair, or adjustments, before or after play, during breaks between play, storage between games, etc. The cradle can also be used for retail display of paintball guns and attachments, and for photographing paintball guns for magazines and catalogs, for example. The cradle is lightweight and can easily be carried along to an indoor or outdoor paintball game. The paintball gun apparatus is quickly and easily placed in the cradle. The cradle protects the gun, which can be quite expensive, from loss and damage. As shown in FIG. 1, a paintball gun apparatus normally has many delicate parts, including the gas cylinder pressure gauge 16 and the tubing 17 between the gas cylinder and the gun, and the paintball dispenser 18 or hopper and its attachment to the gun. The word "apparatus" is meant to include the paintball gun, gas cylinder, paintball dispenser, and any other attachments to the paintball gun. If a paintball gun apparatus is tossed on the ground, these parts are more likely to be jarred loose. The cradle 10 protects these parts from becoming detached.

Continuing with FIG. 1, the support base 12 also includes a cross member 19 having two opposite ends, each affixed to a front end of one of the side members 13. This first cross member 19 connects the side members 13 to each other, and is generally on the same plane as the side members. The cradle 10 preferably also includes a second, rear cross member 20 having two opposite ends, each affixed to a rear end of one of the side members 13. The rear cross member 20 connects the side members and is generally parallel to the first, front cross member 19. It is on the same horizontal plane as the side members and the front cross member. As shown in FIG. 1, the two cross members 19, 20 are positioned approximately at right angles to the opposite ends of the side members 12. In the preferred embodiment where the side members are PVC pipe, the cross members are PVC pipe of a slightly smaller diameter, the ends of the cross members closely fitting into the ends of the side members. The cross members 19, 20 provide stability to the two side members and either one can serve as a handle for transporting the cradle.

Figure 2:
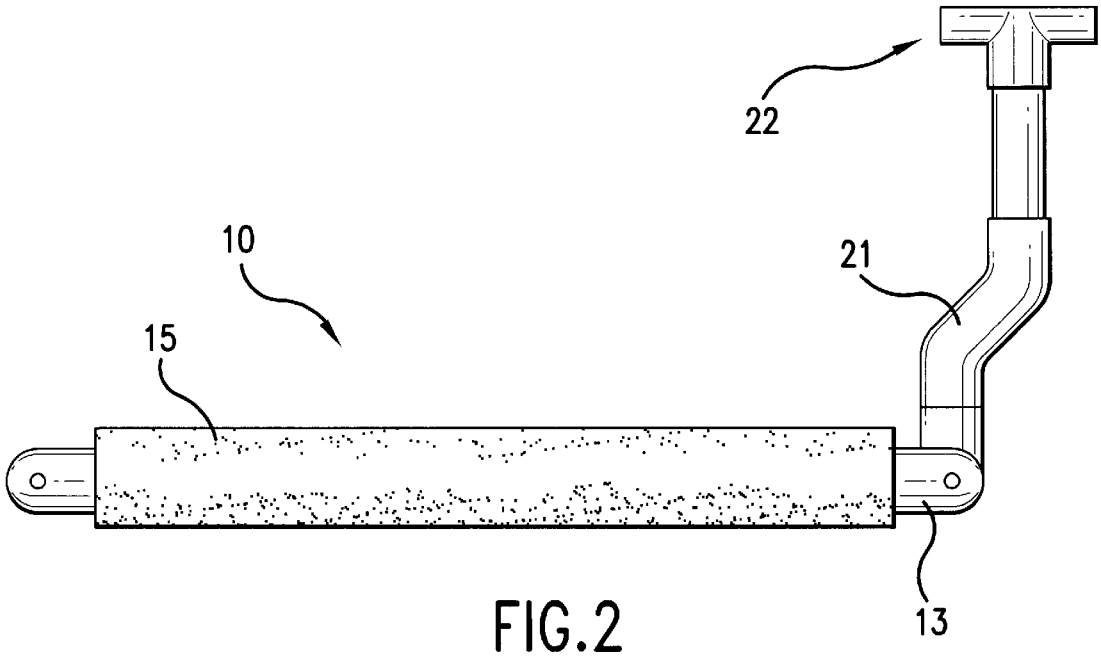
FIG. 2 is an elevational side view of a paintball gun cradle according to the present invention.
Figure 3:
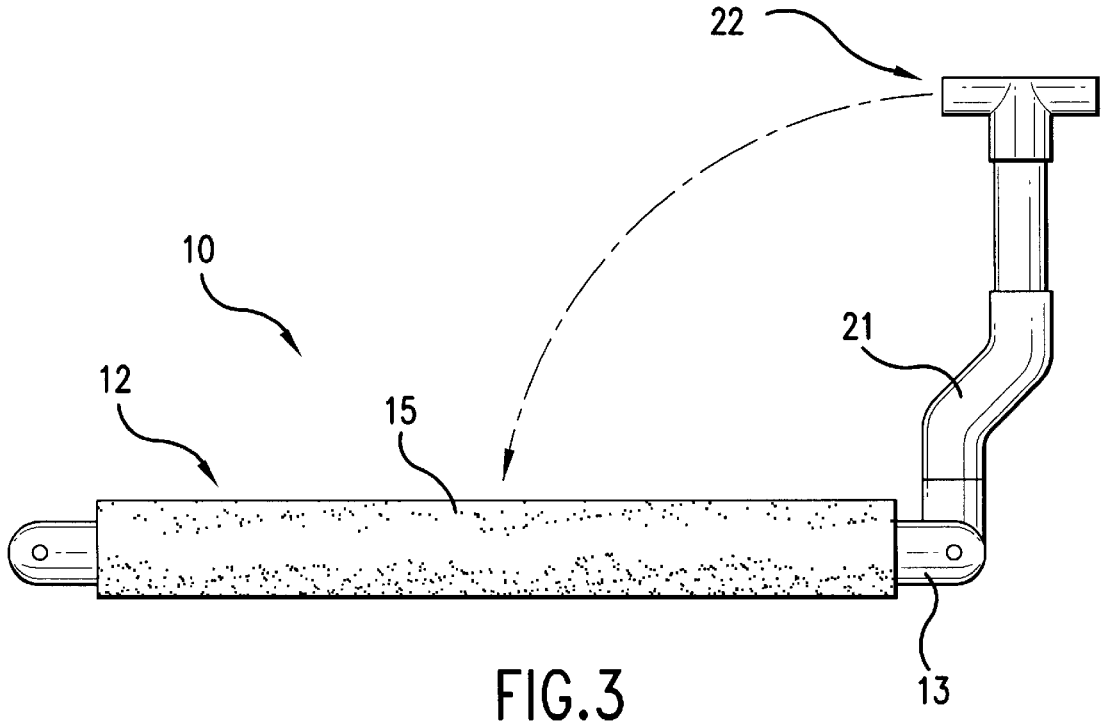
FIG. 3 is an elevational side view of a paintball gun cradle of the present invention, shown with a vertical arm member in a raised position.

Referring to FIGS. 1 through 4, a vertical arm member 21 has an upper end and an opposite, lower end. The vertical arm member is coupled, preferably movably attached, at its lower end to the midsection of the front cross member 19. The vertical arm member extends generally perpendicularly upward relative to the length of the support base. When the cradle is in an open, "ready" position as shown in FIG. 2, the vertical arm member 21 projects vertically upward approximately at a right angle to the front cross member. Thus, the vertical arm member in the open position is not on the same plane as the support base. As illustrated in FIG. 3, the vertical arm member 21 is preferably downwardly collapsible. The two side members 13 are spaced apart a sufficient distance for the vertical arm member to fit between the side members when the device is in a closed position. The vertical arm member can easily be pushed down by the user into the closed position for carrying or storage. The device 10 can include a locking mechanism for locking the vertical arm member into the open and/or the closed positions.

Figure 4:
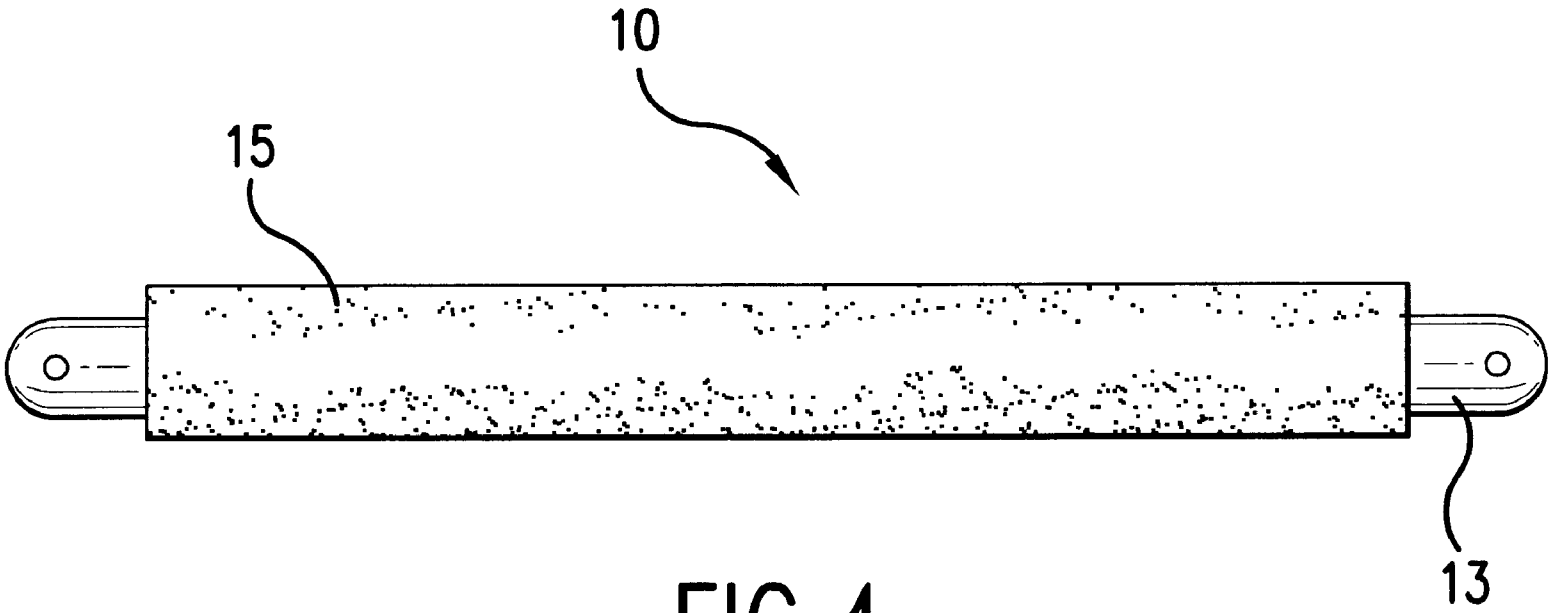
FIG. 4 is an elevational side view of the paintball gun cradle of FIG. 2, shown in a folded position.

FIG. 3 shows the direction of movement of the vertical arm member as it collapses into the support base for more compact storage and easier transport. FIG. 4 shows a side view of the cradle in the closed position. The user can easily carry the closed cradle 10, preferably by holding the rear cross member 20 in one hand. In the closed position, the cradle 10 also fits easily into most gym-type bags. Many paintball players carry their equipment, including gun, extra paint balls, face mask, and vest to and from games in a gym bag.

Continuing with FIGS. 1–4, a T-shaped T-bar portion 22 is attached to the upper end of the vertical arm member 21. The T-bar portion is adapted for supporting the gun barrel 23 of the paintball gun. The T-bar portion is preferably adjustable and removable, and is adapted to fit over the upper end of the vertical arm member.

Figure 7:
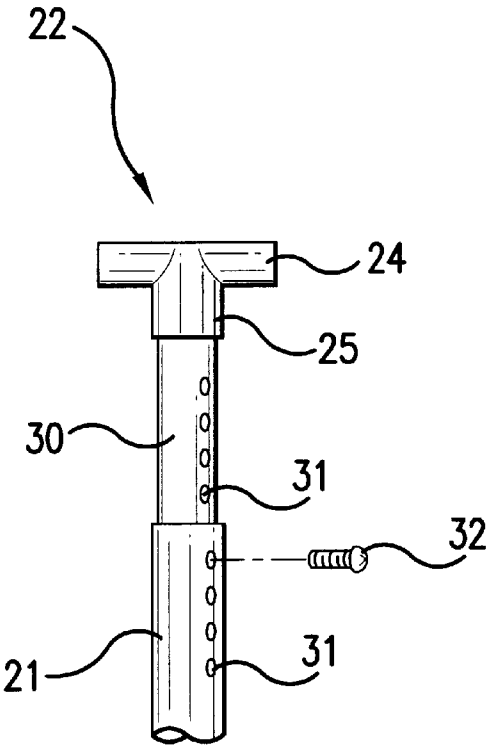
FIG. 7 is an elevational side view of an alternate embodiment of a T-bar portion according to the present invention.
Figure 6:
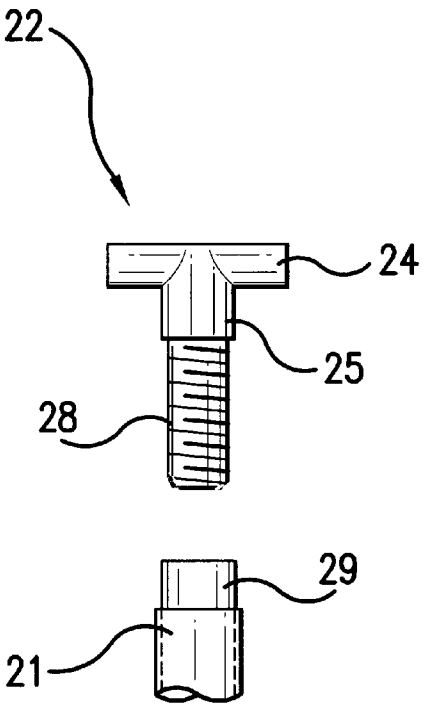
FIG. 6 is an elevational side view of an alternate embodiment of a T-bar portion according to the present invention.
Figure 5:
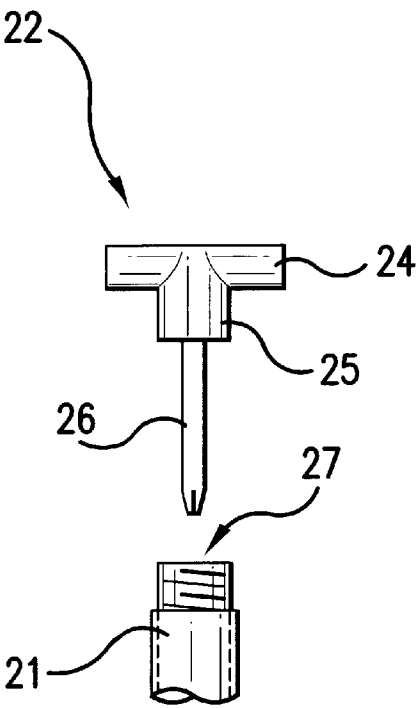
FIG. 5 is an elevational side view of a T-bar portion of a cradle according to the present invention.

Turning now to FIGS. 5–7, the T-bar portion 22 is preferably comprised of two sections: an upper channel section 24 attached perpendicularly to a lower attachment section 25. The channel section 24 has a U-shaped channel along the top for accommodating the gun barrel 23. As shown in FIG. 5, the lower attachment section 25 is preferably removably attached to a handle end of an elongated hand tool, such as a wrench or a screwdriver. The opposite, tool portion 26 of the hand tool protrudes from the end of the attachment section 25. The vertical arm member preferably has a hollow 27 in its upper end. The hollow in the vertical arm member is adapted for holding the hand tool when the tool is not in use. When the vertical arm member is in an open position, the tool points in a downward direction in the arm hollow. The lower end of the attachment section and the upper, open end of the vertical arm member hold corresponding male and female members of an attachment mechanism adapted for removably attaching the T-bar portion to the vertical arm member, such as male and female threading or parts of a snap mechanism.

To use the tool, the user detaches the T-bar portion 22 by unscrewing or unsnapping it, for example. He or she places one hand over the channel section 24 and uses the tool portion 26 to adjust the face mask, for example. The user then pushes the tool portion 26 back down into the hollow 27 of the upper vertical arm member and snaps or screws the lower attachment section 25 into the open end of the vertical arm member.

Paintball gun users will find the embodiment of the T-bar portion providing an Allen wrench especially useful. Allen wrenches are small and easily misplaced. In this embodiment, an Allen wrench is conveniently stored in a closed compartment, the arm hollow, so that it will not be lost or misplaced. The paintball gun user can use the Allen wrench to make minor adjustments on the paintball gun or face mask, for example.

As shown in the alternate embodiment of FIG. 6, the T-bar portion 22 may be attached to the vertical arm member 21 by a removable attachment mechanism. In this embodiment, the T-bar attachment section 25 holds a male threaded portion 28, which snaps or screws into a corresponding female threaded portion 29 in the end of the vertical arm member 21. The male threaded portion 28 has the same diameter as a gun barrel 23, so the T-bar attachment section can serve a second function: to plug the front end of the gun barrel. Many paintball guns have a plug which a user inserts into the barrel for safety when the gun is not in use. A user can purchase the cradle of the present invention with two alternate T-bar portions, such as a T-bar portion with an Allen wrench, as shown in FIG. 5, and a T-bar portion which can also be used as a plug, as shown in FIG. 6.

As shown in the alternate embodiment of FIG. 7, the vertical arm member 21 optionally comprises a mechanism for extending or reducing its length, and for locking the vertical arm member at the desired length. This arm adjustment mechanism expands the range of paintball guns the cradle can hold. Some paintball gun apparatus include gas cylinders of a larger diameter, and some paintball guns are larger than others. Using this mechanism, the vertical arm member can be adjusted so that the channel section 24 fits closely under the gun barrel 23 when the paintball gun apparatus 11 is sitting in the cradle 10.

In the embodiment shown in FIG. 7, an adjustment arm 30 is affixed at one end to the end of the T-bar attachment section 25. At an opposite end, the adjustment arm 30 is slidably connected to the hollow 27 in the end of the vertical arm member 21. The adjustment arm 30 and the inside of the vertical arm member are preferably ridged so that the adjustment arm does not slide around in the vertical arm member. The adjustment arm and the upper end of the vertical arm member have corresponding, spaced apart apertures 31. Once the vertical arm member is adjusted to the desired height, a screw 32 or pin can be inserted onto the set of apertures in the vertical arm member and the adjustment arm to lock the arms in place. Other adjustment mechanisms could be employed for adjusting the height of the vertical arm member.

Figure 10:
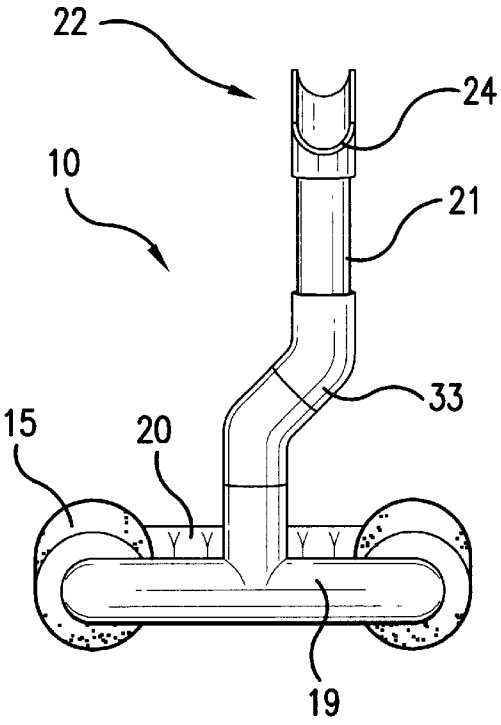
FIG. 10 is a front perspective view of the paintball gun cradle of FIG. 2, showing the goosenecked vertical arm member swiveled to the right.
Figure 9:
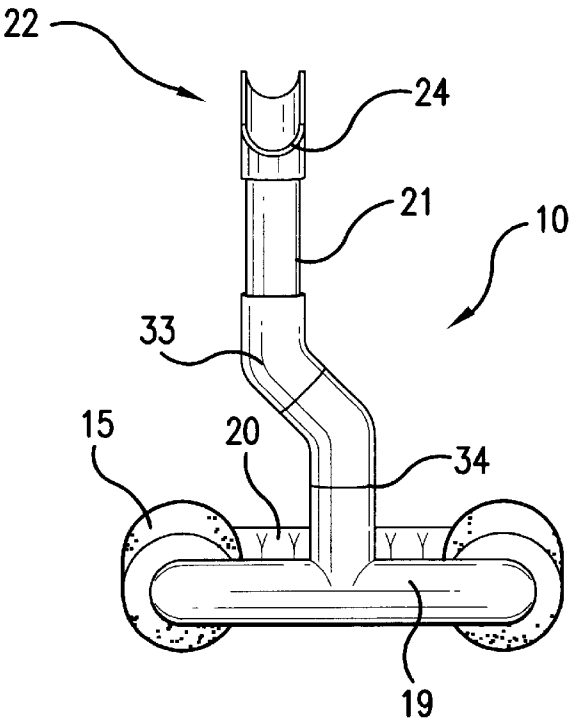
FIG. 9 is a front perspective view of the paintball gun cradle of FIG. 2, showing a goosenecked vertical arm member swiveled to the left.
Figure 8:
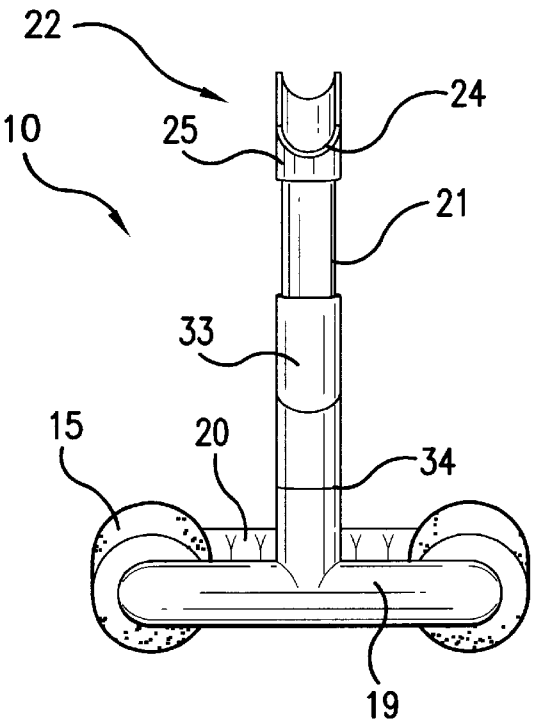
FIG. 8 is a front perspective view of the paintball gun cradle of FIG. 2.

Referring to FIGS. 8–10, some paintball gun apparatus have the gas cylinder offset to the right or left rather than being directly under the paintball gun. A gooseneck section 33 in the vertical arm member allows a user to adjust the cradle to accommodate these three conditions. The user can move the gooseneck into the desired position by grasping it and twisting it into place. The gooseneck section is rotatable at the juncture 34 shown in FIG. 8–10. Using either the front (FIG. 8), right (FIG. 9), or left (FIG. 10) gooseneck positions, the paintball gun cradle readily accommodates various paintball gun styles and models. In this preferred embodiment, the gooseneck structure allows the barrel 23 of the paintball gun to be at different angles relative to the support base.

In an alternate embodiment, the side members 13 and the cross members 19, 20 may also be adjustable to better fit different sized paintball gun apparatus 11. Each side member or cross member could be made of two pieces, one of which fits into the other, so that the length of each side or cross member can be reduced by pushing one piece into the other, or extended by pulling them as far apart as possible. As shown in FIGS. 8–10, the T-bar channel section 24 has a U-shaped channel along the top for accommodating the gun barrel 23.

Figure 11:
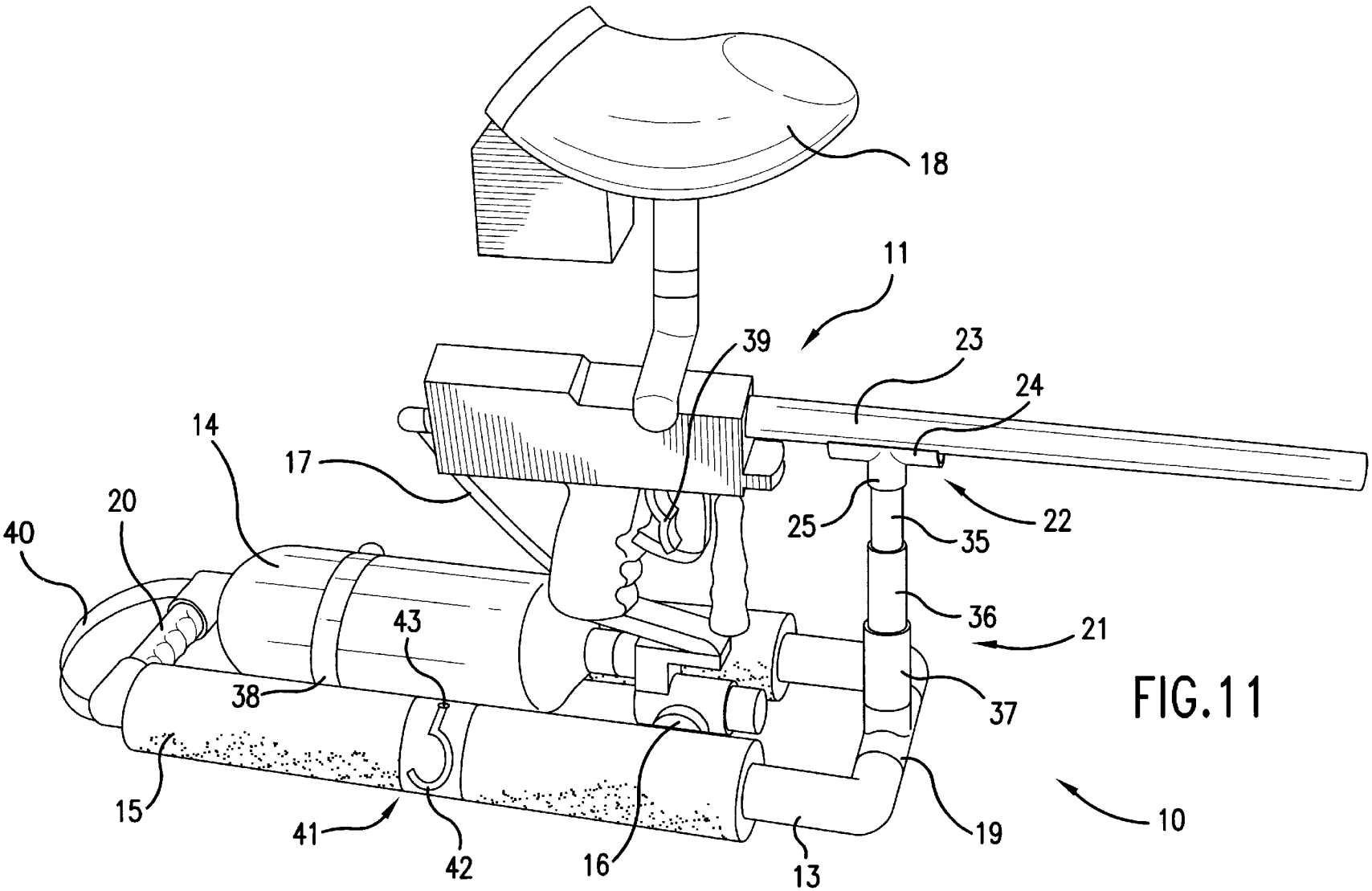
FIG. 11 is a perspective view of an alternate embodiment of a paintball gun cradle according to the present invention.

Referring to FIG. 11, a cradle 10 is shown with a straight, collapsible vertical arm member 21. The vertical arm member is comprised of three segments, each slightly larger than the next. The upper arm segment 35 is collapsible into the middle arm segment 36, which is collapsible into the lower arm segment 37. The vertical arm member can be locked in a fully extended position (height of all three segments), a fully collapsed position (height of lower segment), or a partially extended position (one segment collapsed into the next).

Continuing with FIG. 11, an optional cylinder strap 38 may be provided to secure the gas cylinder 14 and prevent it from sliding. This provides greater protection for the paintball gun apparatus 11. The cylinder strap 38 has two opposite ends, each of which is adapted to fit into a corresponding cylinder strap fitting attached to one of the side members. At least one of the cylinder strap ends is easily detachable from the fitting. The cylinder strap is adapted to fit closely around a paintball gun gas cylinder lying in the cradle. It can function like a belt to strap the cylinder into the cradle.

When a paintball gun 11 is placed in the paintball gun cradle 10 as shown in FIG. 11, the gas cylinder 14 rests on the padded side members 13 and the long barrel 23 of the gun rests in the channel section 24 of the T-bar portion 22. In the cradle 10, the exposed parts of the paintball gun 11 are protected from dirt and impacts. Specifically, the paint ball dispenser 18 is removably affixed to the top of the paintball gun in the cradle, so it is protected from being stepped on or impacted. In the cradle, the gun trigger 39 is protected from being damaged or unintentionally fired. The connections between the ends of the gas cylinder tubing 17 at the gun and at the gas cylinder are also protected from damage while the gun is in the paintball gun cradle 10. The gas cylinder pressure gauge 16, located on the gas cylinder 14 is also protected because it lies between the padded side members 13 of the paintball gun cradle 10.

Continuing with FIG. 11, the cradle 10 may include a grip retaining device 40, preferably one that is attached to a cross member 19, 20. The grip retaining device 40 may be a carrying strap, or a collapsible plastic handle, each attached at opposite ends to the front or rear cross member 19, 20.

As shown in FIG. 11, the cradle 10 may further comprise a removable hook device 41 attached at one end to one of the side members 13. The hook device 41 is adapted for removable attachment of a first cradle to a side member of an adjacent, second cradle. The hook device 41 preferably comprises a hook portion 42 which is movably attached to a pivot pin 43. The hook portion is adapted to fit closely and removably around a portion of a padded side member of the adjacent, second cradle. The hook portion 42 of the hook device rotates about the pivot pin 43 so that the hook portion rests on the side member and is not in the way when it is not in use. To use the hook device 41, the hook portion 42 is rotated and removably hooked over the top or bottom of an adjacent side member of a second cradle which has been positioned next to the first cradle. Using these hook devices or a similar mechanism, a series of cradles can be hooked together side by side, like a bike rack, for holding a series of paintball guns. This keeps the guns organized during breaks at a paintball event.

The cradle of the present invention can also include a strap for hanging the cradle around a stationary object, such as a tree, or the cradle could be hung on a flat surface such as a wall, with or without the gun. Such a strap preferably extends across the bottom of the cradle, with each end of the bottom strap being fastened to a side member. Once the gas cylinder has been strapped on using the cylinder strap, the cradle can be used to store the gun upright, with the gas cylinder in an upward position, by hanging the cradle with the bottom of the side members facing the wall, tree, etc. For long term storage, the paintball dispenser should be removed, and rules concerning the storage of pressurized gas cylinders must be observed.

From the foregoing it can be realized that the described device of the present invention may be easily and conveniently utilized to support paintball guns. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS (For information only)

10 paintball gun cradle
11 paintball gun apparatus
12 support base
13 side member
14 gas cylinder
15 padding
16 gas cylinder pressure gauge
17 gas cylinder tubing
18 paint ball dispenser
19 first cross member
20 second cross member
21 vertical arm member
22 T-bar portion
23 gun barrel
24 channel section of T-bar portion
25 attachment section of T-bar portion
26 tool portion
27 hollow in vertical arm member
28 male threaded portion
29 female threaded portion
30 adjustment section
31 apertures for screw
32 screw
33 gooseneck
34 juncture
35 upper arm segment
36 middle arm segment
37 lower arm segment
38 cylinder strap
39 gun trigger
40 grip retaining device
41 hook device
42 hook portion
43 hook pivot pin

What is claimed is:

1. A portable cradle for supporting a paintball gun apparatus, comprising:

(a) a generally horizontal support base adapted to be disposed on a supporting surface, the support base comprising: (1) a pair of elongated side members, which are parallel to each other and are adapted for supporting a lower side of a gas cylinder of a paintball gun apparatus between them, each side member having a front end and an opposite rear end, and (2) a cross member having two opposite ends, each affixed to the front end of one of the side members; the cross member connecting the side members;

(b) a vertical arm member having an upper end and an opposite, lower end, the lower end being coupled to the cross member, the vertical arm member extending generally perpendicularly upward relative to the length of the support base; and (c) a T-shaped T-bar portion attached to the upper end of the vertical arm member, the T-bar portion being adapted for supporting a gun barrel.

2. A cradle according to claim 1, wherein the T-bar portion is adjustable and removable, and is adapted to fit over an upper end of the vertical arm member.

3. A cradle according to claim 1, wherein the vertical arm member is downwardly collapsible to a position between the two side members for carrying or storage.

4. A cradle according to claim 3, further comprising a second cross member having two opposite ends, each affixed to the rear end of one of the side members; the second cross member being generally parallel to the first cross member.

5. A cradle according to claim 2, wherein the T-bar portion is comprised of an upper channel section and a lower attachment section; the lower attachment section is attached to a handle end of an elongated hand tool; the vertical arm member comprises a hollow in its upper end; and the hollow in the vertical arm member is adapted for storing the hand tool.

6. A cradle according to claim 5, wherein the two side members are comprised of polyvinylchloride pipe, with padding at the points of contact with the gas cylinder of the paintball gun apparatus.

7. A cradle according to claim 3, further including a grip retaining device attached to the cross member.

8. A cradle according to claim 3, wherein the vertical arm member comprises a mechanism for extending or reducing its length, and for locking the vertical arm member at the desired length, for accommodating paintball gun apparatus of different heights.

9. A cradle according to claim 2, further comprising a cylinder strap having two opposite ends, each strap end being adapted to fit into a corresponding cylinder strap fitting attached to one of the side members, at least one of the cylinder strap ends being easily detachable from the fitting, the cylinder strap being adapted to fit closely around a paintball gun gas cylinder lying in the cradle.

10. A cradle according to claim 6, wherein the vertical arm member comprises a gooseneck section and is rotatable.

11. A cradle according to claim 3, wherein the vertical arm member comprises a mechanism for extending or reducing its length, and for locking the vertical arm member at a desired length.

12. A cradle according to claim 6, wherein the vertical arm member is comprised of upper, middle and lower segments, each slightly larger than the next; the upper arm segment is collapsible into the middle arm segment, which is collapsible into the lower arm segment; and the vertical arm member can be locked in fully extended, partially extended, or fully collapsed positions.

13. A cradle according to claim 5, wherein an adjustment arm adapted for adjusting the height of the vertical arm is affixed at one end to the lower end of the T-bar attachment section, and is slidably connected at an opposite end to the hollow in the upper end of the vertical arm member; and wherein the adjustment arm and the upper end of the vertical arm member include corresponding, spaced apart apertures for accommodating a screw or pin.

14. A cradle according to claim 5, further comprising a removable hook device attached at one end to a side member, the hook device being adapted for removable attachment of a first cradle to a side member of an adjacent, second cradle.

15. A cradle according to claim 14, wherein a lower end of the T-bar attachment section and an upper end of the vertical arm member hold corresponding male and female members of an attachment mechanism adapted for removably attaching the T-bar portion to the vertical arm member.

16. A cradle according to claim 15, wherein the hook device comprises a hook portion movably attached to a pivot pin, the hook portion being adapted to fit closely and removably around a portion of a padded side member of the adjacent, second cradle.

17. A cradle according to claim 16, wherein the lower end of the T-bar attachment section includes a male threaded portion, which snaps or screws into a corresponding female threaded portion in the upper end of the vertical arm member; and the T-bar attachment section is adapted to serve as a plug for a front end of the gun barrel.

* * * * *